US011833545B2

(12) United States Patent
Schons et al.

(10) Patent No.: US 11,833,545 B2
(45) Date of Patent: Dec. 5, 2023

(54) SORTING DEVICE FOR SORTING OUT COINS, AND USE OF THE SORTING DEVICE FOR SORTING OUT COINS

(71) Applicants: Georg Schons, Eigeltingen (DE); Marc Schons, Eigeltingen (DE)

(72) Inventors: Georg Schons, Eigeltingen (DE); Marc Schons, Eigeltingen (DE)

( * ) Notice: Subject to any disclaimer, the term of this patent is extended or adjusted under 35 U.S.C. 154(b) by 141 days.

(21) Appl. No.: 17/601,143

(22) PCT Filed: Mar. 17, 2020

(86) PCT No.: PCT/EP2020/057227
§ 371 (c)(1),
(2) Date: Oct. 4, 2021

(87) PCT Pub. No.: WO2020/200756
PCT Pub. Date: Oct. 8, 2020

(65) Prior Publication Data

US 2022/0193724 A1 Jun. 23, 2022

(30) Foreign Application Priority Data

Apr. 3, 2019 (DE) ..... 10 2019 108 732.5

(51) Int. Cl.
*B07B 1/15* (2006.01)
*G07D 9/00* (2006.01)

(52) U.S. Cl.
CPC *B07B 1/15* (2013.01); *G07D 9/00* (2013.01)

(58) Field of Classification Search
CPC .. B07B 1/15; B07B 1/14; B07B 15/00; B07B 1/145; B07B 4/025; B07B 13/003;
(Continued)

(56) References Cited

U.S. PATENT DOCUMENTS 7,806,756 B2 * 10/2010 Umeda ..... G07D 9/00 453/56
9,481,015 B2 * 11/2016 Schons ..... B07B 13/05
2021/0031236 A1 * 2/2021 Schons ..... B07B 4/025

FOREIGN PATENT DOCUMENTS

DE 20217037 U1 4/2003
DE 102018108511 B3 9/2019
(Continued)

OTHER PUBLICATIONS

International search report for patent application No. PCT/EP2020/057227 dated Jul. 24, 2020.

*Primary Examiner* — Patrick H Mackey
(74) *Attorney, Agent, or Firm* — Bachman & LaPointe, P.C.

(57) ABSTRACT

The invention relates to a device for sorting out coins (02), in particular elongated parts (06) and/or copper mesh (07), from a bulk of metal, in particular a bulk of heavy metal and/or NE metal, comprising at least one sorting gap (04) for coins (02), each gap being delimited by at least two rollers. The rollers can be rotated about a rotational axis (A) by means of a drive (13) such that objects which cannot be conveyed through the sorting gap (04), in particular NE metal objects or heavy-metal objects, are forced away from the sorting gap (04) either in a direction along the rotational axes (A) or in a direction perpendicular to the rotational axes (A). According to the invention, the rollers are designed as brush rollers (01), and each brush roller has brushes with at least two different lengths. The bulk of metal is supplied to the brush rollers (01) by a supply device (05) such that the bulk of metal is deposited on the brush rollers (01) at least partly in the longitudinal direction of the rotational axes (A) and/or at least partly perpendicularly to a plane formed by the rotational axes (A).

18 Claims, 7 Drawing Sheets

(58) Field of Classification Search
CPC ..... B07B 13/04; B07B 13/10; G07D 9/00; G07D 9/008; B03C 1/16; B03C 1/18; B03C 1/20
See application file for complete search history.

(56) References Cited

FOREIGN PATENT DOCUMENTS

| | | | | | |
|---|---|---|---|---|---|
| EP | 2672468 | A1 | * | 12/2013 | ..... G07D 3/02 |
| KR | 20040027720 | A | * | 4/2004 | |
| KR | 20070041019 | A | * | 4/2007 | |
| WO | 2013060349 | A1 | | 5/2013 | |
| WO | 2013060584 | A1 | | 5/2013 | |
| WO | WO-2013060349 | A1 | * | 5/2013 | ..... B07B 1/14 |

* cited by examiner

SORTING DEVICE FOR SORTING OUT COINS, AND USE OF THE SORTING DEVICE FOR SORTING OUT COINS

BACKGROUND OF THE INVENTION

The present invention relates to a device for sorting out coins or a sorting device for sorting out coins from bulk metal, in particular from bulk heavy metal or non-ferrous bulk metal. Furthermore, the present invention relates to a use of a device or a sorting device for sorting out coins from bulk metal.

It is known that the incineration of domestic waste, for example, produces about 20% to 25% of solid residue in the form of slag, which itself in turn contains non-ferrous metals, which make up about 1.5% to 2.5% of the slag and at least part of which can be separated from the slag. These non-ferrous metals contain aluminum for the most part but also high-grade non-ferrous metals, such as copper, zinc and different alloys like brass or copper-nickel.

Aside from these metals and alloys, the non-ferrous metal mixture, which can be obtained from the slag of domestic waste incineration or from motor vehicle recycling, for example, is estimated to contain 0.3% to 0.9% coins. The coins contained in such a non-ferrous metal mixture or non-ferrous bulk metal stand out because of their nominal value, which may be up to 560 times higher but is on average at least 10 times higher than the pure metal value. Accordingly, there have been different attempts to recover coins from a metal mixture or bulk metal of this kind. The applicant has conceived of various approaches, which, while having proven functional in principle, still have room for improvement in certain aspects or certain details.

For instance, a device and a method for sorting out coins from bulk metal are known from WO2013060584A1, in which the bulk metal is transported in a conveying direction using a conveying means and a roller is disposed above the conveying means at a distance from the conveying means that forms an appropriate sorting gap, the roller allowing flat metal parts, in particular coins, to pass through while effecting a discharge of metal objects that cannot pass through the sorting gap between the conveying means and the roller, the discharge by means of the rollers taking place in a direction lateral to the conveying direction.

The disadvantage of devices of this kind is in particular that slag from waste incineration processes or bulk metal sorted out therefrom has aggressive or at least highly abrasive properties. For instance, the reactive lime contained in the slag and the residual moisture contained in the slag can cause device components, in particular belts or conveyor belts, to become stuck. Additionally, the humidity of the slag can lead to corrosion of device components. The components of the bulk metal itself can also cause wear of the device components used, in particular belts or conveyor belts, by pointed or sharp portions or sections of the objects of the bulk metal and thereby significantly increase the amount of maintenance and/or repair required for the device for recovering coins from bulk metal or waste incineration slag. As indicated above, however, these disadvantages, i.e., the high operating costs, are particularly critical parameters in terms of economically reasonable coin recovery especially since the coin content of thermally utilized waste, in particular thermally utilized domestic waste, is low.

One approach, which was also conceived of by the applicant and which solves the disadvantages described above in principle, consists in a technology in which the passage of the flat metal parts, in particular the coins, through a sorting gap does not require conveying means in the form of conveyor belts and which additionally offers the option of separating metals, in particular non-ferrous metals, from bulk material immediately prior to sorting out coins from a metal fraction in order to thereby simultaneously save work area and work space for corresponding devices, storage area and storage means for the temporary storage of intermediate products, and labor for the treatment and processing of intermediate products.

Accordingly, patent application DE102018108511 provides a device in which at least one roller forming a sorting gap is disposed in or on an ejection hood, in particular an ejection hood of an eddy-current separating device, relative to a trajectory separator in such a manner that a non-ferrous metal fraction separated from bulk metal by the trajectory separator is guided in the direction of the sorting gap by the weight force of the non-ferrous metal objects.

This technology and this device have proven highly effective, the multiple stages of the separating process or of the sorting process being advantageous in particular since unsorted bulk material, such as waste incineration slag, already constitutes the starting point of the sorting process using the device in question. However, such a device has the disadvantage that it is particularly preferably operated in combination with an eddy-current separator or a similar type of separator for sorting out a non-ferrous metal fraction, which means that the device can be installed or integrated only at specific points of a processing or treatment process, which in turn limits or restricts the applications of the device.

Furthermore, a device and a method for sorting out coins from bulk metal are known from WO2013060349A1, which also originates from the applicant. Therein, means for conveying and/or guiding the bulk metal in a conveying direction are used to convey the objects of the bulk metal toward a sorting gap through which coins can pass and which is defined by a roller configured to be rotated about an axis of rotation by means of a drive in such a manner that metal that cannot be conveyed further in the conveying direction through the gap is forced in a direction away from the sorting gap by the roller. A configuration comprising multiple rollers disposed one behind the other along the conveying direction has also been provided.

A device for sorting peppers by size is known from KR20040027720A, wherein at least two brush rollers are used, each of which is mounted in such a manner that it can rotate, and wherein at least one sorting gap is formed by mounting the brush rollers at an inclination or at different distances.

SUMMARY OF THE INVENTION

Accordingly, the object of the present invention is to enhance a sorting device or a device for sorting out coins from bulk metal in such a manner that the disadvantages in the state of the art are overcome, in particular in such a manner that the device can be equally flexibly placed in the overall processing or treatment process while the maintenance and/or repair costs are still kept low and/or effective sorting-out of coins and other sorting fractions, if applicable, is made possible.

Hereinafter, the term "roller" is to be used synonymously with the term "brush roller" in the context of the description of the invention unless indicated otherwise.

In connection with a device for sorting out coins, and in particular long parts and/or copper wires, from bulk metal, in particular from bulk heavy metal and/or non-ferrous bulk metal, the device comprising at least one sorting gap for coins, each sorting gap being defined by at least two rollers, the rollers being configured to be rotated about their respective axis of rotation by means of a drive in such a manner that objects, in particular non-ferrous metal objects, that cannot be conveyed through the sorting gap are forced away from the sorting gap either in a direction along the axes of rotation or in a direction perpendicular to the axes of rotation and preferably essentially parallel to a plane comprising the axes of rotation, said object is solved in that the rollers are realized as brush rollers and each have bristles of at least two different lengths and the bulk metal is fed to the rollers by means of a feeder in such a manner that at least a portion of the bulk metal is deposited on the rollers in the longitudinal direction of the axes of rotation and/or perpendicular to a plane formed by the axes of rotation.

So the idea underlying the present invention is based in part on the fact that the brush rollers having bristles of at least two different lengths form a sorting gap between them when they are accordingly disposed adjacent to each other, with the result that the coins can be sorted out without excessive wear of the rollers occurring or let alone the geometry of the sorting gap being changed or affected by any adherences or deposits on the rollers. So the sorting gap is not defined or formed by a belt or a conveyor belt. At the same time, however, the feeding of the bulk metal via the feeder according to the invention, in particular relative to the orientation of the rollers or the axes of rotation of the rollers, namely the feeding of at least a portion in the longitudinal direction of the axes of rotation and/or the feeding of at least a portion perpendicular to a plane formed by the axes of rotation, allows coins to be sorted out in a particularly effective manner. Likewise, the idea underlying the present invention is based on the unexpected realization that not only coins but also long parts and/or copper wires can be sorted out simultaneously using said rollers and the appropriately provided feeding of the bulk metal to the rollers or onto the rollers, with the result that another valuable sorting fraction aside from the coins can be generated, which thus increases the economic efficiency of the operation of the device according to the invention or facilitates economic operation of the device. The latter idea underlying the invention is based on the surprising realization that the brush rollers provided according to the invention and the also provided feeding of the metal or the bulk metal via the feeder ensure or achieve that long parts and/or copper wires can be discharged laterally, essentially perpendicular to the axes of rotation of the rollers and also essentially parallel to a plane comprising the axes of rotation of the rollers. The latter discharge direction for wires and long parts shall hereinafter also be referred to as perpendicular to the conveying direction.

Thus, in addition to a coin concentrate, which passes through the sorting gap or the sorting gaps in a direction perpendicular to the axes of rotation of the rollers and essentially perpendicular to the plane formed by the axes of rotation of the rollers, and in addition to the sorting fraction, which is discharged along the longitudinal axes of the rollers or the axes of rotation of the rollers in a direction essentially parallel to the plane of the rollers of the axes of rotation, another fraction or sorting fraction, which comprises the long parts and/or the copper wires, can be generated and is accordingly discharged laterally.

Particularly advantageously, all brush rollers are driven in the same direction of rotation when the device is operated. Accordingly, all brush rollers are configured and may be connected to each other in such a manner that a shared uniform turning direction or direction rotation of all brush rollers is achieved. Thus, the sorting can be configured particularly advantageously, in particular also regarding the sorting out of long parts and copper wires.

According to the invention, the bristles of the rollers are disposed on a bristle support in groups or bundles each having the same length, the bristle support preferably being configured to be attached to a roller shaft in a removable manner. The attachment preferably takes place by establishing a force fit between the roller shaft and the bristle support. By grouping the bristles in bundles or groups each having the same length, a corresponding contour of the roller can be achieved or produced across the outer circumference of the roller. The contour of the outer surface or of the circumferential surface of the rollers can in turn have an advantageous effect on the sorting performance of the device. After all, by appropriately distributing, arranging and/or periodically repeating the placement of the bundles or groups of bristles each having the same length but at least two different lengths in total, the manner in which metal objects, in particular non-ferrous metal objects, are forced in the longitudinal direction, i.e., along the axes of rotation of the rollers, and perpendicular to the axes of rotation of the rollers and are moved or conveyed accordingly can be influenced or controlled. Accordingly, an optimized sorting or sorting-out performance can be achieved. This applies both to the sorting-out of coins and to the sorting-out of long parts and/or copper wires which may be carried out additionally.

According to another preferred configuration of the device, the brush roller or the brush rollers can have a roller shaft configured to be driven to rotate and multiple bristle support elements, the bristle support elements being configured to be slipped onto the roller shafts. For example, it can be provided that the multiple bristle support elements together form a bristle support. The design of the brush rollers with multiple bristle support elements has various advantages. For one example, when only a part of a bristle support or a brush roller is worn or damaged, the costs and the effort for maintenance and repair can be minimized by targeted replacement of the worn or damaged bristle support element. Additionally, different bristle support elements, such as bristle support elements each having bristles of different lengths or a different placement of bristles of different lengths, can be provided and combined, if so required or intended, in order to change the sorting gap, in particular the width of the sorting gap, if required, and to optimize the sorting result or the sorting performance in a manner adapted to the respective application or the respective bulk metal.

Another preferred embodiment of the device provides that the bristles of a first length, preferably a greater or greatest length, of a bristle support and/or a bristle support element form a spiral portion around a longitudinal center axis, preferably the axis of rotation of the brush roller. The longitudinal center axis of the bristle support or of the bristle support element will typically coincide with the axis of rotation of the brush roller when the bristle support or the bristle support elements are mounted on, preferably slipped onto, the appropriate roller, in particular an appropriate roller shaft. Particularly preferably, the spiral portion formed on the brush roller around a corresponding longitudinal center axis or an axis of rotation can effect and control the propulsion or the discharge in the longitudinal direction, i.e., along the axes of rotation of the brush rollers. To this end, the spiral portion is particularly preferably disposed and oriented on the bristle support or the bristle support element in such a manner that the spiral portion effects a propulsion of metal objects located on and/or between the rollers and thus a discharge in the direction of the orientation of the axes of rotation at least for the objects that do not pass through the at least one sorting gap and are not discharged laterally or perpendicularly relative to the orientation of the axes of rotation of the rollers when the roller or the brush roller rotates in the corresponding direction of rotation.

According to a preferred configuration of the device, the bristles of a first length, preferably a greater or greatest length, of a bristle support, which preferably has multiple bristle support elements, can additionally form a preferably uninterrupted spiral around a shared longitudinal center axis, preferably the axis of rotation of the brush rollers. The spiral can have a plurality of complete windings which have a corresponding distance from each other on the brush roller because of the height or the dimension of the pitch of the spiral. The spiral and a spiral portion of a single bristle support element can equally influence, control and/or optimize the propulsion or the discharge in the longitudinal direction along the longitudinal axes or the axes of rotation of the rollers.

Another advantageous embodiment of the device provides that the bristle support or the bristle support elements have force transmission means at longitudinal ends, the force transmission means serving to transmit forces with adjacent bristle support elements and/or shaft end means of the roller shafts. This allows different advantageous effects to be achieved. For one example, this can ensure that not every single bristle support element has to be connected or attached to the roller shaft separately or on its own in order to drive the bristle support elements and thereby rotate the brush roller. After all, if force transmission means are provided at said longitudinal ends in the form of teeth, for example, they can mesh with each other when bristle support elements are disposed next to each other and interact or mesh with the corresponding shaft end means when bristle support elements are disposed at the edges, which in turn means that all that is required is for such a connection to be established between the roller shaft and the shaft end means. The shaft end means can preferably be realized as adjusting rings which are for their part attached to the roller shaft in a removable manner by means of fixing means, such as grub screws. It is particularly preferred for all force transmission means at the respective ends of the bristle support elements but also across the bristle support elements to be of an identical design. After all, this allows simple replacement, change and/or substitution of individual bristle support elements. Further preferably, the force transmission means, which are in the form of teeth, for example, are realized in such a manner that force transmission is achieved via a form fit between the bristle support elements and/or the shaft end means.

As explained above, there are different options for influencing the transport of the metal objects, in particular of the non-ferrous metal objects, on the brush rollers. For one example, the placement and orientation of the feeder can have an impact to that effect. For another example, as discussed above, the bristles of different lengths of the brush rollers and their corresponding placement on the brush rollers or the bristle supports (bristle support elements) can have an impact on how, in particular how fast, metal objects deposited on the brush rollers are discharged or conveyed. Another option for setting the discharge speed, in particular in the direction of the axes of rotation of the brush rollers, can be obtained by tilting the respective axes of rotation relative to the horizontal. In this context, it has proven particularly advantageous for the axes of rotation to be disposed horizontally or to form an angle of 0° to 20°, preferably 0° to 10°, particularly preferably 0° to 5°, with the horizontal, the inclination being selected in such a manner that a discharge of the bulk metal from the device, preferably in the direction along the axes of rotation, is facilitated or accelerated. In general, this means that the axes of rotation are situated deeper on the side that faces away from the feeder. Advantageously, the situation or inclination of the axes of rotation can be continuously adjusted and fixed in the given angle range.

In order to produce a coin concentrate or a concentrate of coins of highest possible value which consists of the metal objects that pass through the sorting gap or the at least one sorting gap, it is particularly important to design the width of the sorting gap in the most ideal manner possible. The sorting gap or the sorting gaps of the present invention or of the device described at hand is/are essentially formed by the shorter or shortest bristles of adjacent brush rollers. An advantageous embodiment of the device accordingly provides that the adjacent brush rollers are disposed relative to each other in such a manner that distance of 2 to 7 mm, preferably of 3 to 6 mm, is formed between the shortest bristles of adjacent rollers. This allows a coin concentrate to be produced which has a high coin content and only a relatively small content of other flat parts.

Furthermore, it has proven advantageous for parts of the sorting gap or of the sorting gaps, i.e., the area between the respective opposing shortest bristles of the brush rollers, to also be combed by the longer bristles. However, it has proven to be particularly advantageous in this regard for the longer bristles of a respective roller and the shortest bristles of a respective adjacent roller to not meet, let alone mesh. Instead, a particularly advantageous embodiment of the invention provides that adjacent brush rollers are disposed relative to each other in such a manner that there is always a distance of 0.5 mm to 1.5 mm, preferably of 0.8 mm to 1.2 mm, between the longest bristles of one roller and the shortest bristles of an adjacent roller. This distance relates to the situation that the respective shortest and longest bristles face each other and are aligned essentially parallel to each other, i.e., in the situation at about the height of the axis of rotation of the respective rollers with the shortest and the longest bristle facing each other.

This distance or this definition of the distance also applies to the aforementioned dimension of the distance between shortest bristles of respective adjacent brush rollers.

In another embodiment, adjacent brush rollers can be disposed relative to each other in such a manner that a preferably constant distance of less than 45 mm, preferably less than 42 mm, particularly preferably less than 40 mm, is formed between the longest bristles of adjacent rollers in the direction of the axes of rotation. As used herein, constant is to be interpreted as constant over time. So the distance of the longest bristles is not supposed to change during rotation. This maximum distance of the longest bristles in the longitudinal direction or in the direction of the axes of rotation can be easily adjusted especially when the longest bristles form spiral portions or spirals. The distance can be designed to alternate, which means that a greater distance is followed by a smaller distance, none of the distances exceeding the maximum distance. The difference in the consecutive distances in the longitudinal direction can have an impact on the discharge speed in the longitudinal direction and can be advantageously set depending on the application. By maintaining the maximum distance, another "sorting dimension" can be established in a particularly advantageous manner. After all, only flat parts that are nowhere broader or thicker in one dimension than the sorting gap is wide and are nowhere longer or bigger than 45 mm, preferably 42 mm, particularly preferably 40 mm, in an essentially perpendicular second dimension can pass through the sorting gap. However, this also has the effect that the objects passing through the sorting gap all have dimensions that are very similar to that of the coins to be sorted out. Consequently, the advantageous relative situation of the longest bristles of adjacent rollers in the longitudinal direction or in the direction of the axes of rotation achieves a further increase in quality of the sorted out coin concentrate.

For one example, it can be provided for the brush rollers to be disposed in a fixed manner on a support device, such as a frame device, which is to be described in more detail below. In this case, the respective distances of the axes of rotation and the distances of the roller shafts are fixed or set and cannot be changed per se. In this case, the distances, i.e., the distance between shortest bristles and the distance between shortest bristles on one side and longest bristles on the other side, can be adjusted or varied by mounting different bristle supports or bristle support elements having accordingly adjusted bristles, in particular bristles accordingly adjusted in length, on the rollers, in particular the roller shafts. In an alternative embodiment, however, it can also be provided that the position of the rollers or of the brush rollers themselves on an understructure, such as a frame, can be changed and the rollers or the brush rollers can be fixed in the respective changed position, which means that the distances can also be changed without replacing the bristle supports or the bristle support elements by changing the position of the brush rollers overall. In order to produce a particularly valuable or pure coin concentrate, it has proven advantageous for the brush rollers, in particular the bristles of the brush rollers that are the most common on a brush roller, to define an outer diameter of the brush roller that is adjusted to the spectrum of diameters of the coins to be sorted out. After all, the outer contour or the essential portion of the surface of the brush rollers has a curvature in a certain area, said curvature facilitating the standing-up or the erection of the coins to be sorted out by the rotation of the rollers. Accordingly, an advantageous embodiment provides that the rollers have an outer diameter that is selected in such a manner that coins deposited on the rollers are moved in the direction of the sorting gap and are erected in the process by the rotation of the rollers, said outer diameter preferably being defined by the shortest bristles. Preferably, the outer diameters of the brush rollers can be 10 cm to 30 cm, preferably 15 cm to 28 cm.

It has also been found that long parts can be effectively discharged laterally if the long parts are deposited on the rollers in a specific basic orientation. In particular, this has also the advantage that long parts especially cannot unintentionally or accidentally pass through a sorting gap and lower the purity of the coin concentrate. Accordingly, a particularly advantageous embodiment of the device provides that the feeder has a long-parts pre-alignment means which serves to deposit long parts on the rollers in such a manner that the longitudinal axis of the long parts is perpendicular to the axes of rotation of the rollers or the brush rollers and essentially parallel to a plane comprising the axes of rotation. After all, the surfaces of the rotating rollers or brush rollers discharge the thus oriented long parts particularly effectively tangentially to the respective rotations sideways, i.e., essentially perpendicular, to the orientation of the axes of rotation of the brush rollers or perpendicular to the conveying direction. Copper wires does not require orientation or pre-alignment. Copper wires will also be moved essentially perpendicular to the conveying direction by a sort of transfer effect in the course of the concordant rotation of the brush rollers and will then be conveyed on a last roller until the wires reach the area of transition to the second to last roller on the underside, where the wires will then be wiped off. The pre-alignment of the long parts and the adhesion and transfer effect of the wires on the bristles of the bristle rollers improves the quality of the coin concentrate while jamming of copper wires between the brush rollers is prevented and the directed discharge or the directed ejection of the long parts and the copper wires ultimately forms another sorting fraction, which can be re-utilized or recycled accordingly.

In another particularly advantageous embodiment of the device, the feeder can additionally comprise a vibration element, in particular a vibration chute, which effects or at least supports the feeding of the bulk metal. Particularly advantageously, the vibration chute or the vibration element can simultaneously also act as the long-part pre-alignment means in order to effect the pre-alignment of the long parts and of the copper wires described above. Additionally, the vibration element enables uniform and targeted feeding or metering of the bulk metal reaching the brush rollers. Alternatively, the long-parts pre-alignment means can also be provided separately from the feeder and may interact with the feeder.

A particularly advantageous embodiment of the device also provides that the brush rollers can have a drive journal which is connected, preferably in a removable manner, particularly preferably screwed, to a roller shaft, in particular a hollow shaft. A severable connection between the drive journal and the roller shaft enables easy and simple maintenance and simple replacement, if required. Screw connections have proven particularly advantageous, an internal thread preferably being provided on an inner surface of a hollow shaft and a corresponding external thread being preferably provided on the drive journal. The use of hollow shafts as the roller shaft is particularly suitable for saving weight and reducing the moments of inertia of the brush rollers.

Particularly preferably, the drive journal can have drive means, in particular double gear wheels, and/or bearing means configured to interact with bearing seats. This allows all brush rollers of the device to be driven by a single drive or by a shared drive, which is achieved by coupling the drive to one of the double gear wheels of the drive journal of a brush roller via a drive chain, for example, and in turn having one of the double gear wheels drive the respective consecutive or adjacent brush rollers and having the latter drive the respective consecutive or adjacent brush roller via another double gear wheel. The bearing means are typically configured in such a manner that the brush roller or the brush rollers of the device only require a bearing on one side, namely in the area of the drive journal of the brush roller. In this context, too, the use of hollow shafts as the roller shafts is preferred since the weight that consequently has to be borne by the bearing or the bearing means is reduced. As an alternative to hollow shafts, drawn tubes can also be used in general. Overall, one-sided bearing, in particular if it is disposed in the area of the feeder of the device, makes it possible for the brush rollers to form an open or loose assembly on the side or the end facing away from the bearing or the drive journal. This in turn has the advantage that the parts that are discharged between the brush rollers in the longitudinal direction, i.e., along the direction of the axes of rotation of the brush rollers, and that do not pass through the sorting gap entirely but may protrude into the area between the brush rollers or may even protrude into the area of the sorting gap or even cross through it do not lead to jamming, build-up or similar blockages when leaving the brush rollers since the respective brush rollers advantageously form an open end owing to the one-sided bearing.

Additionally, it can also be advantageous if the brush rollers are attached to a frame or accommodated by a frame, which preferably forms a U-shape and is therefore open on one side. First, such a frame offers the necessary basic stability for the placement and the attachment of the brush rollers. Second, a frame open on one side, which is formed by three adjacent legs in a U-shape, for example, also allows the frame of the brush rollers to be open on the side of the brush roller opposite the bearing, thereby also preventing the jamming, the build-up or the wedging of discharged metal objects of the bulk metal.

Spoons are a typical example for metal objects whose spoon handle can penetrate the area between the brush rollers, i.e., the area of the sorting gap, and lead to jams and build-ups at the discharge end of the brush rollers, which, however, can be prevented by the open situation of the roller ends and/or the frame.

On the basis of the common dimensions of eddy-current separators, another particularly advantageous design of the sorting device for sorting out coins provides that the frame has a roller assembly having a width of 1 m or 1.5 m or 2 m, a ratio of 6 rollers per 1 m of width of the roller assembly being preferably maintained. This means that nine rollers are employed when a frame has a roller assembly of a width of 1.5 m and that 6 or 12 brush rollers are disposed side by side when a frame has a roller assembly of a width of 1 or 2 m, respectively.

Additionally, the invention relates to a use of a device described above for sorting out coins from bulk metal, in particular non-ferrous bulk metal or bulk heavy metal.

Particularly preferably, the invention also relates to a use of such a device for additionally sorting out long parts and/or copper wires from bulk metal, in particular non-ferrous bulk metal or bulk heavy metal. Particularly preferably, the device is used after a separation of a non-ferrous metal fraction, in particular an eddy-current separation of a non-ferrous metal fraction. Other advantages, features and details of the invention are apparent from the following description of preferred examples of embodiments and from the drawings, which schematically illustrates the subject matter of the invention.

DETAILED DESCRIPTION

Figure 1:
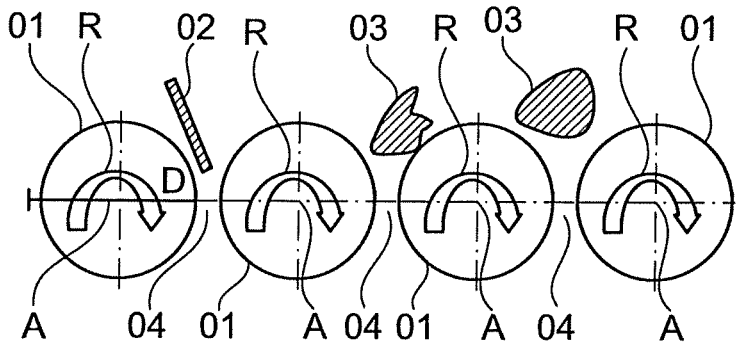
FIG. 1 is a schematic illustration for clarifying the sorting principle of the device according to the invention.

The schematic functional sketch of FIG. 1 shows four brush rollers 01 as examples, whose respective axes of rotation A run perpendicular to the drawing plane of FIG. 1. All brush rollers 01 can be or are driven in the same direction, as indicated by directional arrows R of FIG. 1. A feeder, which is not illustrated in FIG. 1, feeds bulk metal, in particular non-ferrous bulk metal, onto brush rollers 01. This means that the bulk metal is deposited on brush rollers 01 from above. In addition to coins 02, the bulk metal comprises other volume parts 03 and long parts, which are not illustrated in FIG. 1. A sorting gap 04 is formed between brush rollers 01 in each case, sorting gap 04 being essentially defined by the shorter or shortest bristles of respective brush rollers 01. For reasons of clarity, the bristles are not illustrated in the functional sketch of FIG. 1. The sorting gap can have a width of 2 to 7 mm, preferably 3 to 6 mm, for example. Via the longer or longest bristles of brush rollers 01, which are not shown in detail in FIG. 1, the rotation of the brush rollers about axes of rotation A propels or conveys the bulk metal perpendicular to the drawing plane of FIG. 1, wherein objects that end up between brush rollers 01 and are nowhere broader overall than sorting gaps 04 can pass through them. This is the case for outlined coin 02, for example. Volume parts 03 on the other hand are transported across brush rollers 01 perpendicular to the drawing plane, i.e., along the direction of axes of rotation A, and are discharged and separated at the end of brush rollers 01. The mode of operation of the device according to the invention with regard to long parts, cables, in particular copper wires, will be discussed in more detail with reference to the illustration of FIG. 2. The outer circumference of the brush rollers, which is essentially defined by the shortest bristles, is selected in such a manner that when roller 01 rotates about axis of rotation A, coin 02 is moved in the direction of sorting gap 04 and is erected in the process in order to pass through sorting gap 04 as easily as possible.

Figure 2:
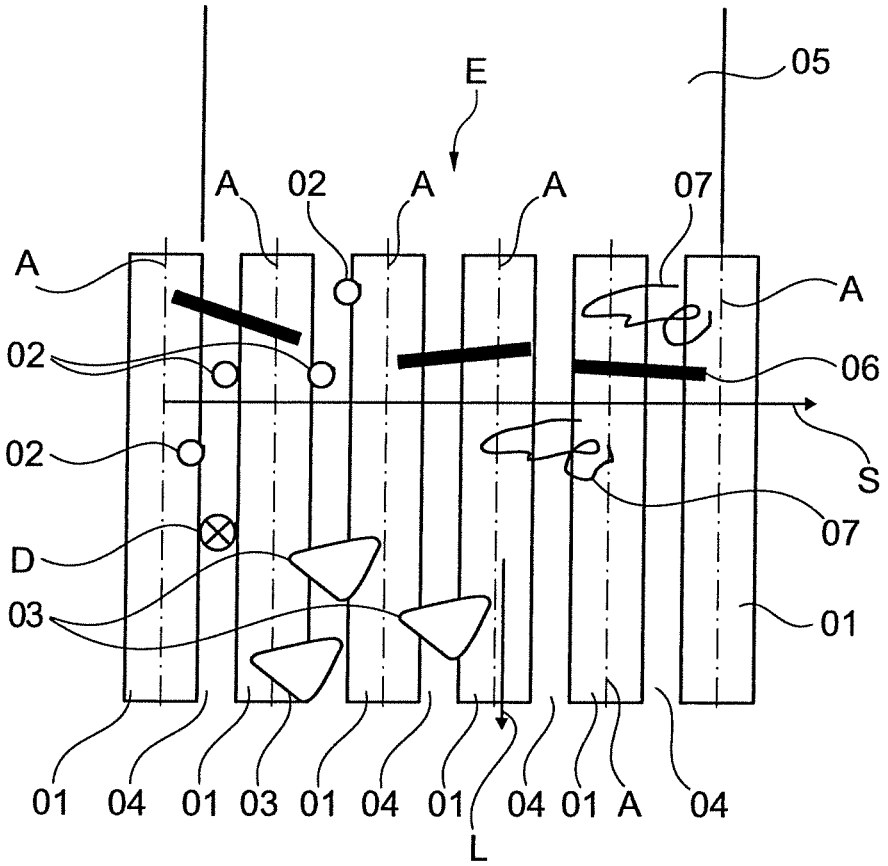
FIG. 2 is a schematic illustration of the basic function of the device according to the invention.

In addition to illustrating an assembly of a total of six brush rollers 01 and their respective axes of rotation A, FIG. 2 also shows a schematic illustration of feeder 05, which is used to deposit the bulk metal, in particular the non-ferrous bulk metal, onto brush rollers 01. The bulk metal is essentially deposited along depositing direction E via feeder 05. As also illustrated in FIG. 1, brush rollers 01 each rotate clockwise in the same direction about respective axes of rotation A. Coins 02 and other flat parts of similar dimensions can pass through sorting gaps 04, which are formed between brush rollers 01, in a passage direction D perpendicular to the drawing plane, whereas volume parts 03 are discharged and separated or sorted out along longitudinal direction L of axes of rotation A. Longitudinal direction L, which runs in the drawing plane, defines also coincides with what is referred to as the conveying direction. Long parts 06 and the wires, in particular the copper wires 07, are discharged laterally, which is indicated by directional arrow S, perpendicular to the extension of axes of rotation A and essentially parallel to the plane formed by axes of rotation A. As a result, another sorting fraction is formed, said sorting fraction ensuring a consequent value of the sorting fraction by concentrating the wires, in particular copper wires 07. Likewise, this ensures that copper wires 07 do not contaminate or damage the brush rollers. Ultimately, the content of long parts in the objects sorted out through sorting gaps 04, i.e., in the coin concentrate, is reduced, thereby also improving the purity of the coin concentrate.

Figure 3:
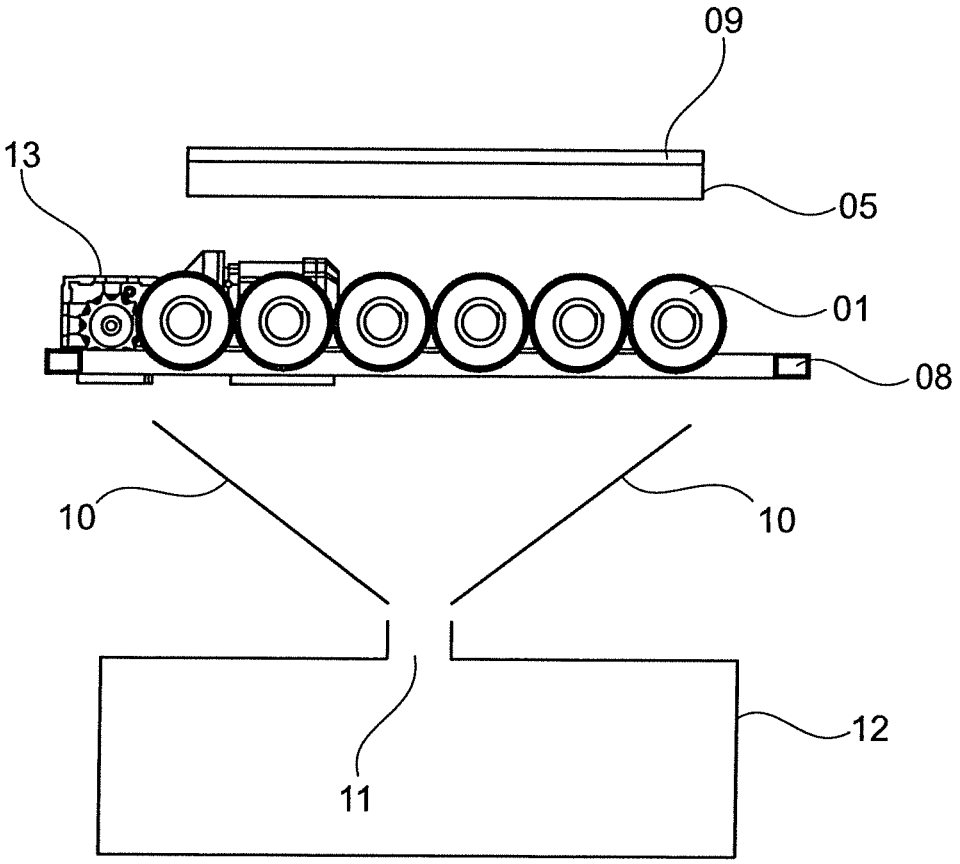
FIG. 3 is a schematic illustration showing a front view of a device according to the invention.

The illustration of FIG. 3 shows that six brush rollers 01 are once more disposed on a shared frame 08, wherein feeder 05, which additionally has a long-parts pre-alignment means 09, is disposed slightly above and behind rollers 01. Long-parts pre-alignment means 09 ensures that long parts 06 are preferably disposed on brush rollers 01 at an orientation, which is outlined in FIG. 2, for example, namely with a longitudinal axis extending essentially perpendicular to the longitudinal axes of brush rollers 01, i.e., axes of rotation A of brush rollers 01. Long-parts pre-alignment means 09 can be mounted in a movable manner in order to be able to set a distance as ideal as possible from the end of feeder 05. Preferably, the distance does not exceed 45 mm.

Additionally, guiding members 10, in particular guiding sheets 10, are provided below frame 08, guiding members 10 guiding or directing the non-ferrous metal objects passing through sorting gaps 04 toward a gap opening 11 of a safety collecting container 12 of the device. Gap opening 11 of safety collecting container 12 is designed in such a manner that the coins of the coin concentrate collected in safety collecting container 12 cannot be manually accessed. Guiding members 10 preferably form an angle of more than 45° with the horizontal in order to ensure that the flat parts safely slide or slip into safety collecting container 12. The illustration of FIG. 3 also shows a shared drive 13 of the device, which ensures the driving of brush rollers 01. The details of the drive will be discussed in more detail in the description of FIG. 4.

Figure 4:
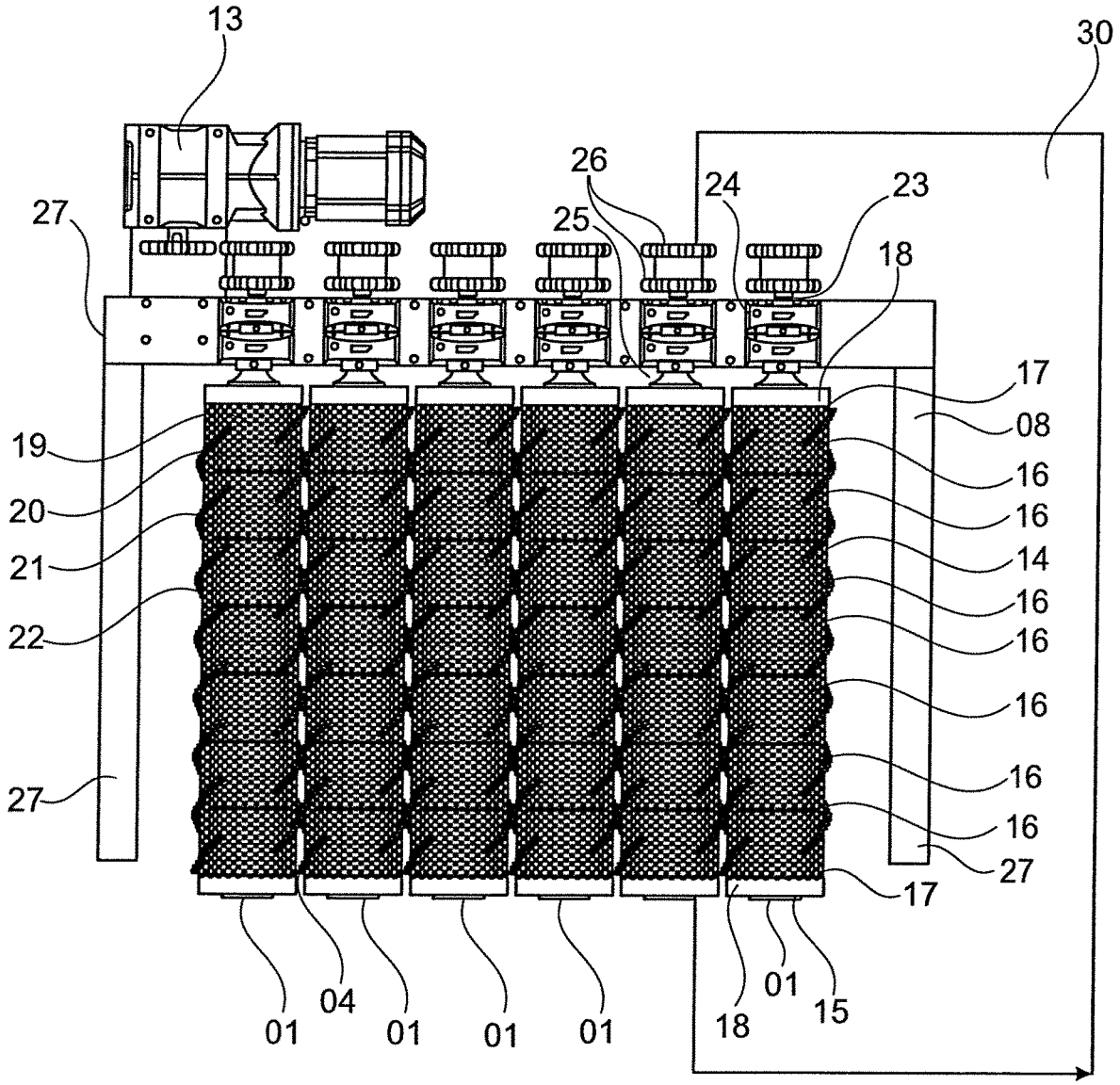
FIG. 4 is a schematic illustration showing a top view of part of the device according to the invention.
Figure 5:
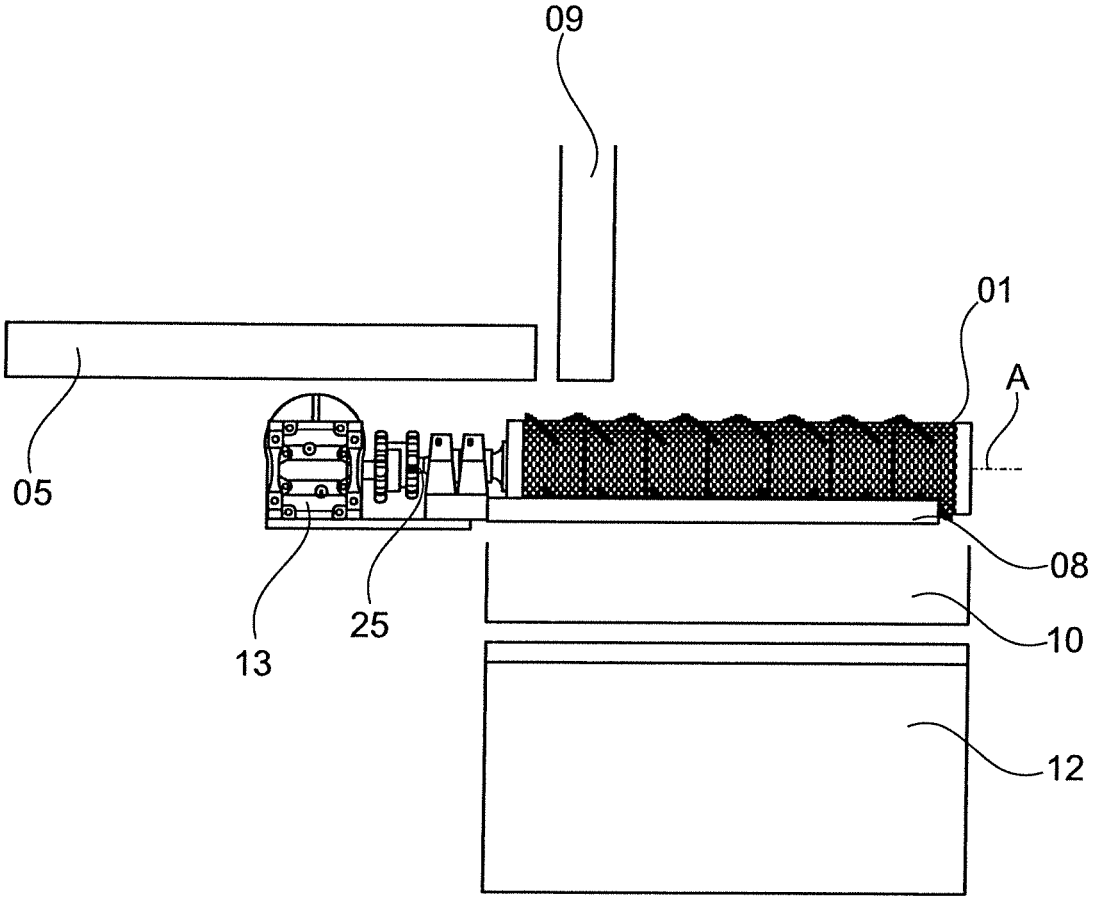
FIG. 5 is a schematic illustration showing a side view of a device according to the invention.

The top view of FIG. 4 again illustrates U-shaped frame 08 and brush rollers 01 attached thereto. The illustration of FIG. 4 shows that the respective brush rollers have a bristle support 14, which is disposed on a roller shaft 15. In the example of FIG. 5, bristle support 14 is in turn composed of seven individual bristle support elements 16. At opposing longitudinal ends, bristle support elements 16 each have force transmission means 17 in the form of teeth, by means of which bristle support elements 16 are connected to each other and by means of which the bristle support elements 16 are also connected in a form-fitting and therefore force-fitting manner to shaft end means 18 disposed at the ends of roller shafts 15. Shaft end means 18 can be realized as adjusting rings, for example, which are provided with appropriate grub screws in order to fix shaft end means 18 to roller shaft 15.

Furthermore, FIG. 4 shows that bristle support 14, in particular bristle support elements 16, of brush rollers 01 each have groups or bundles 19 of bristles 20 each having the same length, wherein the groups or bundles 19 of the bristles that have a greater or greatest length form a spiral portion 21 around the longitudinal center axis of bristle support 14 or bristle support element 16. In the illustration of FIG. 4, respective bristle support elements 16 are disposed relative to each other in such a manner that groups 19 of bristles 20 that have the greatest length form a continuous spiral 22. Spiral 22 effects the discharge of the volume parts in the direction of axes of rotation A of the brush rollers. Moreover, if the long parts and/or the copper wires are pre-aligned appropriately, a lateral discharge of said components of the non-ferrous bulk metal is ensured.

FIG. 4 additionally shows that brush rollers 01 are mounted on frame 08 on one side, bearing means 23 comprised by brush rollers 01 being accommodated in corresponding bearings 24 of the frame for this purpose. Also, brush rollers 01 comprise drive means, such as double gear wheels 26, on the bearing side in the area of drive journals 25, which also have bearing means 23, said drive means enabling brush rollers 01 to be driven by means of shared drive 13, wherein drive 13 effects direct driving via a first chain connection with one of the double gear wheels of brush roller 01 adjacent to drive 13 and the consecutive double gear wheels of brush rollers 01 are each used to transmit the drive energy from the respective preceding brush roller or the brush roller disposed further to the left to consecutive brush roller 01 or brush roller 01 disposed further to the right. Belts can also be used as transmitting means as an alternative to chains.

Additionally, monitoring means, which are not illustrated in detail in the figures, can be provided, said monitoring means allowing the speed of the drive and/or of the brush rollers to be monitored. If an unintended deviation of the speed from a target speed is detected, preferably in the event of a standstill, the drive can be automatically stopped and the direction of rotation of the drive can subsequently be changed for about three revolutions, for example. This process can be repeated a predetermined number of times, such as three times, before the drive is fully shut down and an error signal is output via output means, such as acoustic output means.

For reasons of clarity, the chains for connecting the gear wheels of brush rollers 01 and drive 13 are not illustrated in FIG. 4.

As mentioned before, frame 08, on which brush rollers 01 are disposed, is composed of three individual legs 27 in the U-shape of a U, the open side of frame 08 being associated with the end of the brush roller assembly opposite the bearing of brush rollers 01. The one-sided bearing, drive journal 25 of brush rollers 01, and the design of frame 08 open on one side all advantageously enhance the discharge of volume parts along the longitudinal axis or axis of rotation A of the brush rollers. After all, metal objects cannot jam or build up at the open end of frame 08 or at the free end of brush rollers 01 in the illustrated embodiment.

Covers in the form of sheets, for example, can be disposed the distance between lateral legs 27 of the frame and the rollers or brush rollers. If it is intended for long parts and copper wires to be sorted out, no cover is needed on the side perpendicular to the discharge direction on which the long parts and the wires are discharged. Instead, a collecting vessel 30 for long parts and wires can be disposed below frame 08 in this area, which also comprises the gap between leg 27 and the last roller.

The brush rollers illustrated in FIG. 4 are disposed relative to each other in such a manner that a distance of 2 to 7 mm, preferably of 3 to 6 mm, is formed between shortest bristles 20 of adjacent brush rollers, which essentially forms sorting gap 04 between adjacent brush rollers 01. The distance between shortest bristles 20 of one brush roller and longest bristles 20 of an adjacent brush roller 01 is between 0.5 and 1.5 mm, preferably between 0.8 and 1.2 mm. The respective distances are determined at the height of axes of rotation A of brush rollers 01 when respective opposite bristles 20 are essentially aligned with or parallel to each other.

FIG. 5 again shows a side view of the device, in which guiding members 10 and safety collecting container 12 as well as feeder 05, which is preferably realized as a vibration chute or as a conveyor belt, and frame 08, which supports brush rollers 01, are illustrated. Feeder 05 can be a vibration chute, for example. Alternatively, the feeder can at least comprise a vibration chute. The situation of feeder 05 relative to brush rollers 01 shows that at least a portion of the objects of the bulk metal is deposited on brush rollers 01 in the longitudinal direction of axes of rotation A and/or at least a portion thereof is deposited on brush rollers 01 perpendicular to a plane formed by axes of rotation A. The respective portion of the depositing direction (which can be split up vectorially) of the metal objects on brush rollers 01 depends on the distance between feeder 05 and brush rollers 01. Also, the respective portion depends on the speed at which the metal objects leave feeder 05. This means that when the speed at which the metal objects leave feeder 05 is relatively low and the distance between feeder 05 and brush rollers 01 is additionally relatively large, a depositing direction on the brush rollers arises which is essentially perpendicular to a plane formed by the axes of rotation of brush rollers 01, wherein the orientation of feeder 05 relative to axes of rotation A of brush rollers 01 typically maintains an albeit small portion of the depositing direction that extends in the longitudinal direction of axes of rotation A of brush rollers 01. The greater the speed at which the metal objects leave feeder 05 and the smaller the distance from brush rollers 01, the stronger the extension of the depositing direction of the bulk metal in the longitudinal direction of axes of rotation A of the brush rollers 01. The described depositing direction of the bulk metal on the brush rollers 01 allows the coins to be sorted out from the bulk metal in a particularly efficient manner. Additionally, in particular if long parts are pre-aligned accordingly, a very effective lateral sorting-out of these components of the bulk metal is achieved, wherein the design of brush rollers 01 each with at least two types of bristles of different lengths in combination with the depositing direction of the bulk metal on the brush rollers described above allows the different fractions of the bulk metal to be sorted out or separated in a particularly effective manner according to the invention.

The illustration of FIG. 5 shows that axes of rotation A of brush rollers 01 run horizontally. Alternatively, the axes of rotation can also be inclined by 0° to 20°, for example, in which case the ends of brush rollers 01 that face away from drive 13 and drive journal 25 can be situated lower, with the result that the propulsion or the discharge of volume parts in the direction of axes of rotation A is facilitated. Preferably, the inclination can be continuously adjusted and set by the operator of the device.

FIG. 5 also shows the situation of long-parts pre-alignment means 09 relative to feeder 05. Long-parts pre-alignment means 09 is realized as a curtain, for example, which has a distance of no more than 45 mm, preferably no more than 40 mm, from the end of feeder 05 and is oriented parallel to the width of feeder 05. Incoming long parts are oriented essentially perpendicular to the drawing plane by the resistance of long-parts pre-alignment means 09 before they can pass the gap between feeder 05 and long-parts pre-alignment means 09 are deposited on the brush rollers. The distance from feeder 05 can be selected in such a manner that it particularly preferably interacts with the assembly of the bristles and the groups or bundles of bristles. To this end, the distance from the feeder can preferably be selected to be equal to maximum distance d3 according to the description of FIG. 8 in order to achieve an ideal pre-alignment and thus a lateral pre-sorting-out of long parts.

Figure 6:
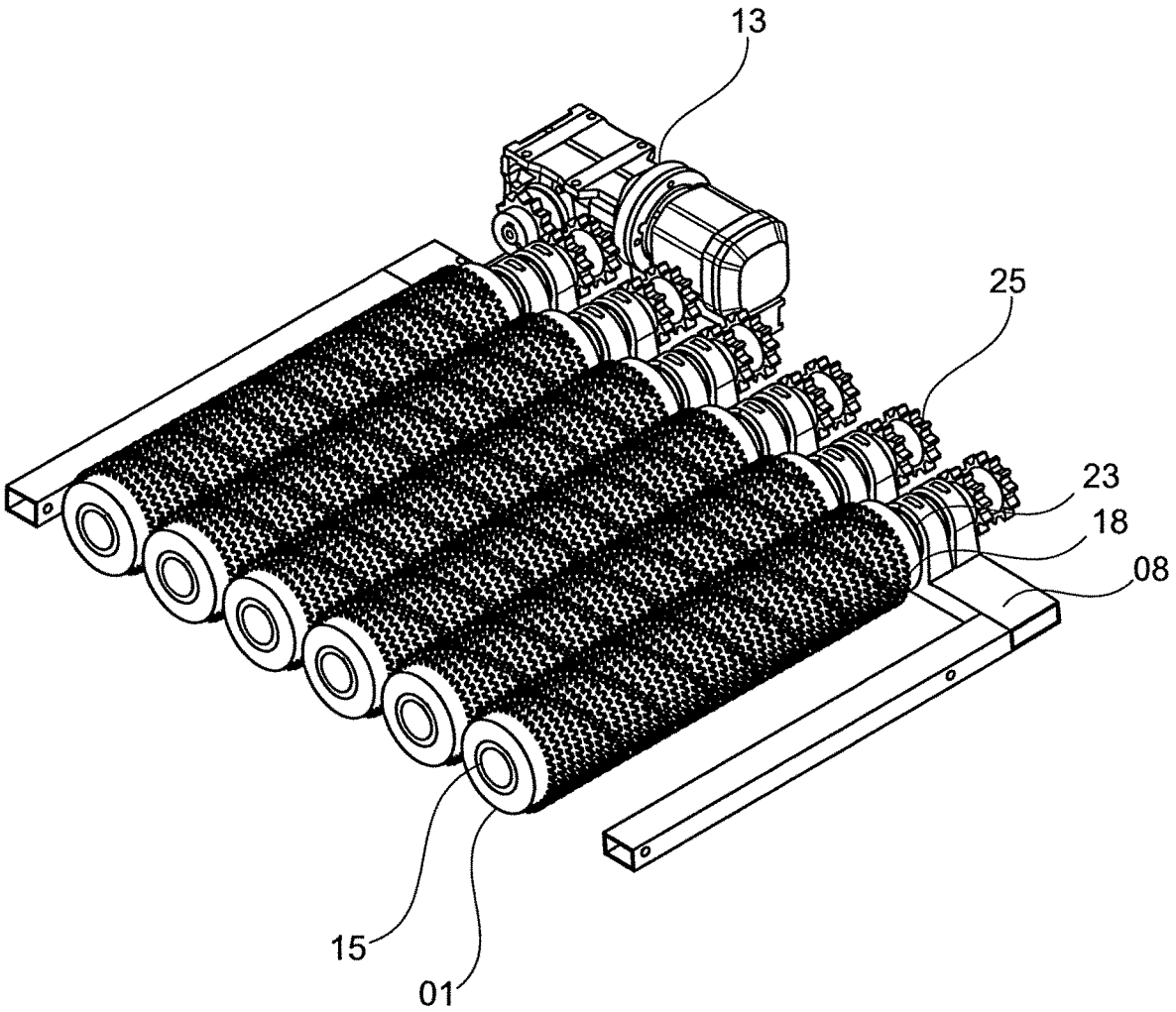
FIG. 6 is a schematic illustration showing a perspective view of a section of a device according to the invention.

FIG. 6 shows a perspective illustration of frame 08 and of brush rollers 01 fastened thereon and of drive 13 for driving brush rollers 01. In the area between rear shaft end means 18 and bearing means 23, shaft 15 of brush rollers 01 ends in a drive journal 25. The design of roller shaft 15 and the design of drive journal 25 are shown in detail in the illustration of FIG. 7, as is the transition between roller shaft 15 and drive journal 25.

Figure 7:
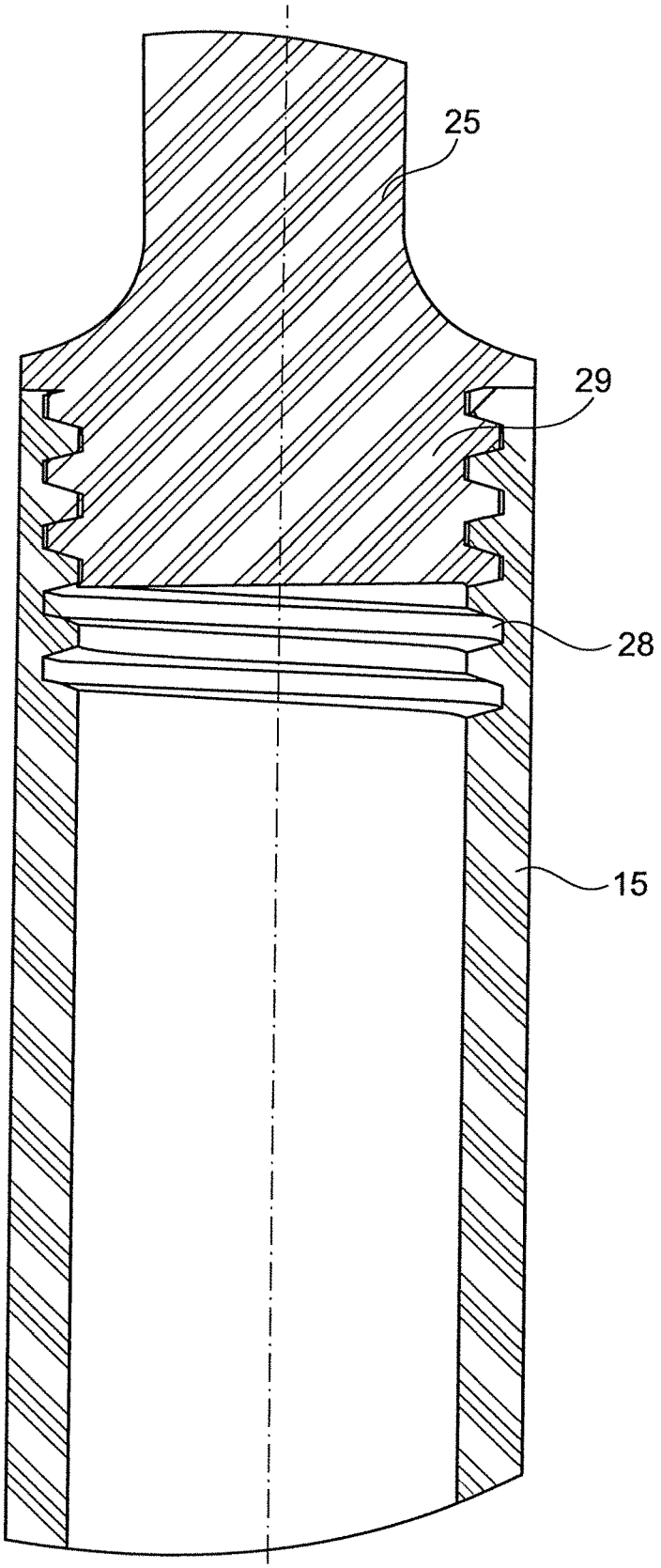
FIG. 7 is a schematic cross section through a roller shaft of a brush roller.

FIG. 7 shows a cross section through roller shaft 15 without the bristle supports or the bristle support elements disposed thereon. Roller shaft 15 is realized as a hollow shaft or a drawn tube and comprises an internal thread 28 at one end, internal thread 28 interacting with an external thread 29 of drive journal 25 and thereby forming a severable connection, in particular a screwed connection, between hollow shaft 15 of brush roller 01 and drive journal 25. Bearing means 23 and double gear wheels 26 can be disposed on, in particular attached to, drive journal 25 in an area not shown in the illustration of FIG. 7.

Figure 8:
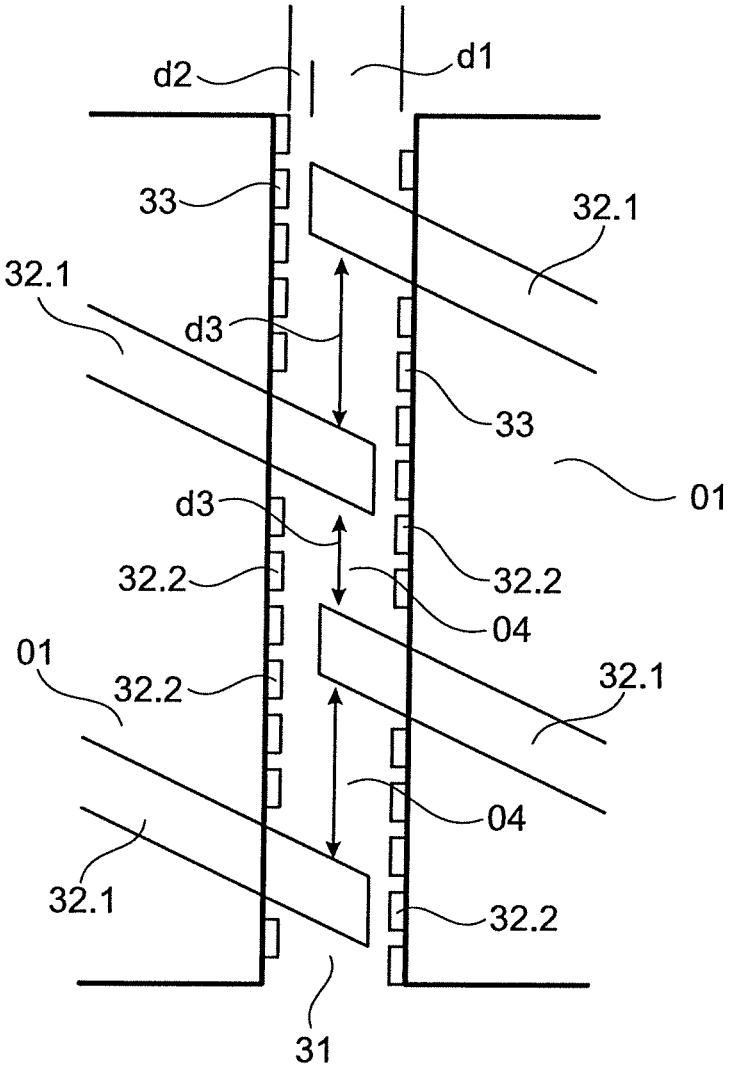
FIG. 8 is a schematic illustration of a space between two adjacent brush rollers.

FIG. 8 shows a section of a space 31 between two brush rollers 01, which forms a sorting gap 04. Bristles 32 or groups 33 of bristles 32, which have two different lengths, protrude into space 31. Groups 33 or the bundles that have longer bristles 32.1 form a spiral. Shortest bristles 32.2 are evenly distributed between the spirals. The groups of shortest bristles 32.2 outside of the space have not been illustrated for reasons of clarity. As can be seen, a first distance d1, which can be 2 mm to 7 mm, is formed between groups 33 of shortest bristles 32.2 of two adjacent brush rollers 01. This distance forms a first limit or dimension of sorting gap 04. A second distance d2, which can be 0.5 mm to 1.5 mm, is formed between respective shortest bristles 32.2 and long bristles 32.1 of adjacent brush rollers, distance d2 essentially serving to propel the objects located between brush rollers 01 in the conveying direction, i.e., along axes of rotation A.

Longer bristles 32.1 can also define a distance in the conveying direction or along axes of rotation A of the brush rollers. This distance is formed because longer bristles 32.1 are disposed in such a manner that they radially overlap. Distance d3 in the conveying direction can be selected in such a manner that it particularly preferably supports the sorting out of coins and/or objects having similar dimensions or measures. To this end, it can be provided for distance d3 to not exceed 40 mm, for example. This forms a second definition or dimension of sorting gap 04. The situation could also be considered in such a manner that a plurality of consecutive sorting gaps 4 are formed in the longitudinal direction of axes of rotation A in space 31 between two adjacent brush rollers 01, said sorting gaps 4 each extending between longer bristles 32.1 of adjacent brush rollers 01 and thus having a length d3 as well as width d1. Thereby, the situation of the brush rollers and their bristles enable a "two-dimensional" sorting or sorting-out function since only objects having a thickness of up to approximately d1 and a size or a diameter of up to d3 can pass through sorting gap(s) 04.

As illustrated in FIG. 8, distance d3 is realized in an alternating manner in the direction of axes of rotation A, with the result that a larger and a smaller distance d3 are formed. The asymmetrical situation of longer bristles 32.1 and resultant alternating distances d3 allow a particularly advantageous influence to be exerted on the discharge speed in the conveying direction. However, since smaller distance d3 also forms a sorting gap 04, smaller coins can also pass through it, for example. So when longer bristles 32.1 are disposed asymmetrically, it is still important that no distance d3 exceeds a maximum value of 40 mm, for example.

REFERENCE SIGNS

01 brush rollers
02 coins
03 volume parts
04 sorting gap
05 feeder

06 long parts
07 copper wires
08 frame
09 long-parts pre-alignment means
10 guiding members
11 gap opening
12 safety collecting container
13 drive
14 bristle support
15 roller shaft
16 bristle support elements
17 force transmission means
18 shaft end means
19 groups or bundles
20 bristles
21 spiral portion
22 spirals
23 bearing means
24 bearing
25 drive journal
26 double gear wheels
27 leg
28 internal thread
29 external thread
30 collecting vessel
31 space
32 bristles
32.1 long bristles
32.2 short bristles
33 groups
A axis of rotation
L longitudinal direction
E depositing direction
D passage direction
d1 first distance
d2 second distance
d3 third distance

The invention claimed is:

1. A device for sorting out coins (02), and long parts (06) and/or copper wires (07), from bulk metal, the device comprising:

at least one sorting gap (04) for coins (02), each sorting gap being defined by at least two rollers, the rollers being configured to be rotated about an axis of rotation (A) by means of a drive (13) in such a manner that objects that cannot be conveyed through the sorting gap (04) are forced away from the sorting gap (04) either in a direction along the axes of rotation (A) or in a direction perpendicular to the axes of rotation (A), wherein the rollers are realized as brush rollers (01) and each have bristles (32) of at least two different lengths, and a feeder (05) for feeding the bulk metal to the brush rollers (01) in such a manner that at least a portion of the bulk metal is deposited on the brush rollers (01) in the longitudinal direction of the axes of rotation (A) and/or perpendicular to a plane formed by the axes of rotation (A), the bristles (32) being disposed on a bristle support (14) in groups (33) or bundles (19) each having the same length.

2. The device according to claim 1, wherein at least one the brush roller of the brush rollers (01) has a roller shaft (15), which is configured to be driven to rotate, and multiple bristle support elements (16), the bristle support elements (16) being configured to be slipped onto the roller shaft (15).

3. The device according to claim 1, wherein the bristles (32.1) of a bristle support (14) and/or a bristle support element (16) that have a first length form a spiral portion (21) around a longitudinal center axis of the brush rollers (01).

4. The device according to claim 3, wherein adjacent brush rollers (01) are disposed relative to each other in such a manner that a constant distance (d3) of less than 45 mm is formed between the longest bristles of adjacent brush rollers (01) in the direction of the axes of rotation (A).

5. The device according to claim 3, wherein the bristles (32.1) have the first length which is a greatest length.

6. The device according to claim 1, wherein the bristles (32.1) of the bristle support (14), which comprises multiple bristle support elements (16), that have a first length, form an uninterrupted spiral (22) around a shared longitudinal center axis of the brush rollers (01).

7. The device according to claim 1, wherein the bristle support (14) or bristle support elements (16) of the bristle support (14) have force transmission means (17) at longitudinal ends, the force transmission means (17) serving to transmit forces with adjacent bristle support elements (16) and/or shaft end means (18) of the roller shafts (15).

8. The device according to claim 1, wherein the axes of rotation (A) are disposed horizontally or form an angle of 0° to 20° with the horizontal, the inclination being selected in such a manner that a discharge of the bulk metal from the device is facilitated or accelerated.

9. The device according to claim 1, wherein adjacent brush rollers (01) are disposed relative to each other in such a manner that a distance (d1) of 2 mm to 7 mm is formed between the shortest bristles (32.2) of adjacent brush rollers (01).

10. The device according to claim 1, wherein adjacent brush rollers (01) are disposed relative to each other in such a manner that a distance (d2) of 0.5 mm to 1.5 mm is formed between the longest bristles (32.1) of one brush roller (01) and the shortest bristles (32.2) of an adjacent brush roller (01).

11. The device according to claim 1, wherein the brush rollers (01) have an outer diameter which is selected in such a manner that coins deposited on the rollers (02) are moved in the direction of the sorting gap (04) and erected in the process by the rotation of the brush rollers (01).

12. The device according to claim 1, wherein the feeder (05) has a long-parts pre-alignment means (09) which serves to deposit long parts on the brush rollers (01) in such a manner that the longitudinal axis of the long parts (06) is perpendicular to the axes of rotation (A) of the brush rollers (01) and essentially parallel to a plane comprising the axes of rotation (A).

13. The device according to claim 1, wherein the feeder (05) comprises a vibration element which effects or at least supports the feeding of the bulk metal.

14. The device according to claim 1, wherein the brush rollers (01) have a drive journal (25) which is removably connected to a shaft.

15. The device according to claim 14, wherein the drive journals (25) have drive means and/or bearing means (23) for interacting with bearing seats.

16. The device according to claim 1, further comprising a U-frame (08) open on one side, for receiving or fastening the brush rollers (01).

17. The device according to claim 16, wherein the brush roller assembly in the frame (08) has a width of 1.0 m or 1.5 m or 2.0 m, a ratio of 6 brush rollers (01) per 1 m of width of the brush roller assembly being maintained.

18. The device according to claim 1, wherein the bristle support (14) is configured to be attached to a roller shaft (15) in a removable manner.

* * * * *